US005770146A

United States Patent [19]

Ebner

[11] Patent Number: 5,770,146

[45] Date of Patent: Jun. 23, 1998

[54] SYSTEM FOR THE HEAT TREATMENT OF METALLIC ANNEALING MATERIAL

[76] Inventor: Peter Helmut Ebner, Bergham 168, A-4060 Leonding, Austria

[21] Appl. No.: 733,022

[22] Filed: Oct. 16, 1996

[30] Foreign Application Priority Data

Oct. 19, 1995 [AT] Austria ..... 1741/95

[51] Int. Cl.[6] ..... C21D 1/06

[52] U.S. Cl. ..... 266/252; 266/251

[58] Field of Search ..... 266/257, 262, 266/263, 251, 252; 432/152, 198, 200; 239/451, 455, 456

[56] References Cited

FOREIGN PATENT DOCUMENTS 0905293 2/1982 U.S.S.R. ..... 266/251

*Primary Examiner*—Scott Kastler

*Attorney, Agent, or Firm*—Collard & Roe, P.C.

[57] ABSTRACT

A system for the heat treatment of metallic annealing material (1, 12) comprising a distributor (3) for the heating or cooling medium consisting of air or a gas, where for the formation of an oblique blast the distributor (3) has tubular or slot-shaped nozzles (4, 4*a*) directed against the annealing material (1, 12) possibly lying on a transport means (2). For changing the distance of the nozzle orifice from the workpiece surface, the nozzles (4, 4*a*) are provided with retractable extensions (5, 5*a*) for increasing the distance between nozzle orifice and annealing material (1, 12).

3 Claims, 2 Drawing Sheets

FIG.1
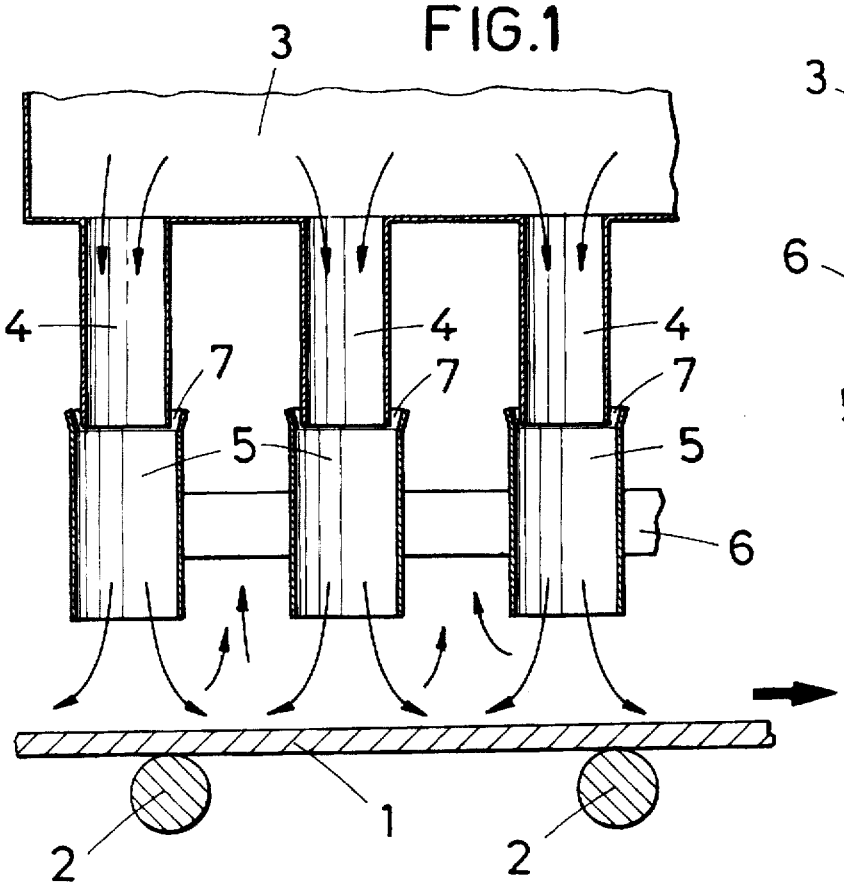
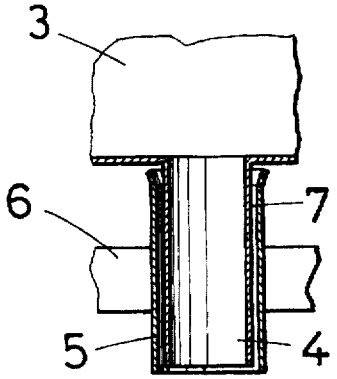
FIG.2
FIG.3
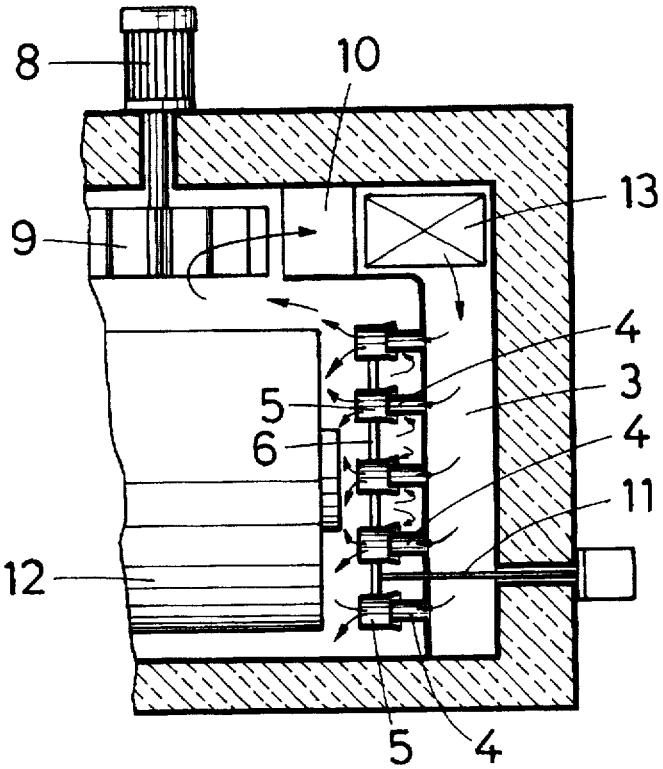

SYSTEM FOR THE HEAT TREATMENT OF METALLIC ANNEALING MATERIAL

This invention relates to a system for the heat treatment of metallic annealing material, comprising a distributor for the heating or cooling medium consisting of air or a gas, where for the formation of an oblique blast the distributor has tubular or slot-shaped nozzles directed against the annealing material possibly lying on a transport means.

It is known that the effect of an oblique blast emerging from the nozzle orifice is increasing with decreasing distance thereof from the annealing material. However, a proper discharge of the heating or cooling medium must be ensured. In the case of round nozzles, the limit distance is about 0.7 of the nozzle outlet diameter, and in the case of slot-shaped nozzles it approximately corresponds to the slot width. When for inspection purposes examination personnel is moving through systems for high-quality light-metal sheets, as they are used for instance in the aircraft industry, there must of course be ensured a passage height of 450 mm, so that the distances of the nozzle orifices from the annealing material are a priori determined to be 450 mm. To provide the oblique blast with the required energy for the transport of the heating or cooling medium to the surface of the annealing material, large recirculation flow rates and high pressures are required due to the comparatively large distance of the nozzle orifice from the surface of the annealing material. This leads to a correspondingly high expenditure of energy and a high flow rate of heating or cooling medium.

It is therefore the object of the invention to eliminate this deficiency and reduce the expenditure of energy and flow rate with comparatively simple means.

This object is solved by the invention in that for increasing the distance between nozzle orifice and annealing material the nozzles are provided with retractable extensions.

By means of these extensions, the nozzle outlet can thus be adjusted to an optimum distance from the surface of the annealing material. When the surface of the annealing material differs from a planar shape, e.g. due to a distortion or change in plate thickness, the nozzle outlets can easily be adapted to the shape of the annealing material by means of the retractable extensions. By means of these extensions there can also be provided sufficient space for inspection purposes.

The extensions can together be adjusted by means of a frame preferably consisting of struts, where the distance of the outlet opening of the nozzles from the surface of the annealing material can both be defined by means of a measuring device and also visually by the operating personnel. In any case, the adjustment is neither time-consuming nor does it involve much effort.

In accordance with the invention, a narrow space that is open on the side of the distributor has been left between the nozzle body and the extension. As a result of the high speed at which the oblique blast emerges, an injector effect is achieved which further improves the heat transfer to the workpiece.

In some cases it is more favorable to design the nozzles as openings in the shell of the distributor and to make the extensions retractable into the openings.

BRIEF DESCRIPTION OF THE DRAWINGS

In the drawing, the subject-matter of the invention is represented by way of example and purely schematically, wherein:

FIG. 1 shows a part of a system for the heat treatment of metallic annealing material in a vertical section, FIG. 2 shows a tubular nozzle with retracted extension in the same representation, FIG. 3 shows a system for the heat treatment of strip coils in a chamber furnace.

In accordance with FIG. 1 a plate-shaped annealing material 1 is passed in direction of the arrow through the heat treatment system by means of drive rollers 2. Above the annealing material 1 there is provided a distributor 3 charged with air or gas for heating or cooling purposes, which comprises tubular nozzles 4 directed against the annealing material 1, which tubular nozzles are provided with telescopically movable extensions 5. By means of the nozzles 4 or the extension 5 an oblique blast is formed for the surface of the annealing material 1. As can in particular be seen in FIG. 4, the extensions 5 are connected by struts 6 to form a frame, which can be adjusted from the outside. FIG. 1 shows the usual position of the extension 5, whereas in FIG. 2 a fully retracted extension 5 is shown. Between the nozzle body 4 and the extension 5 an open space 7 has been left on the side of the distributor, in order to achieve an injector effect. FIG. 3 is a schematic representation of a system for the heat treatment of strip coils. A motor 8 drives a fan 9 including a distributor 10, which conveys the heating or cooling medium to the distribution space 3, which is in turn provided with nozzles 4 and extensions 5, where the frame formed by the struts 6 has an adjusting device 11. The heating or cooling medium impinging as an oblique blast on the workpiece surface, namely a strip coil 12, is recirculated to the distribution space 3 by the fan 9, where a heating means 13 is disposed before said distribution space. FIG. 5 shows the design of slot-shaped nozzles 4*a*, where the extension 5*a* is provided with spacers 14.

Figure 4:
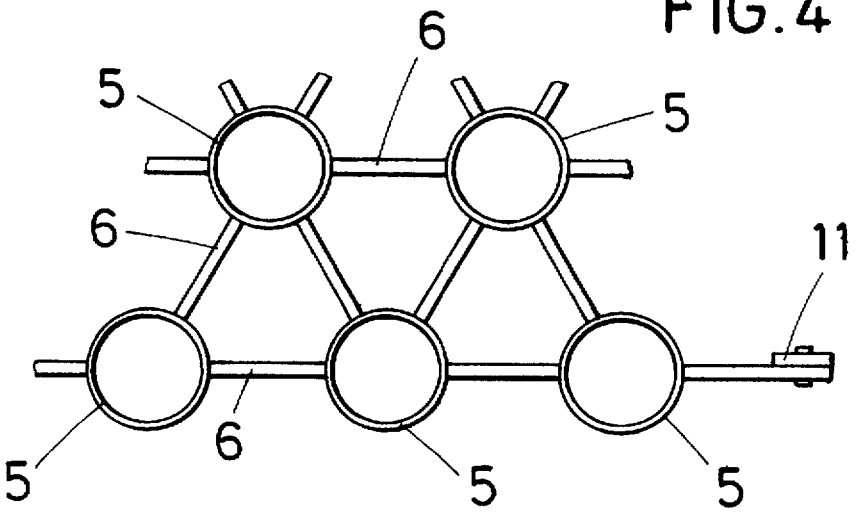
FIG. 4 shows the arrangement of tubular nozzles in a top view.
Figure 5:
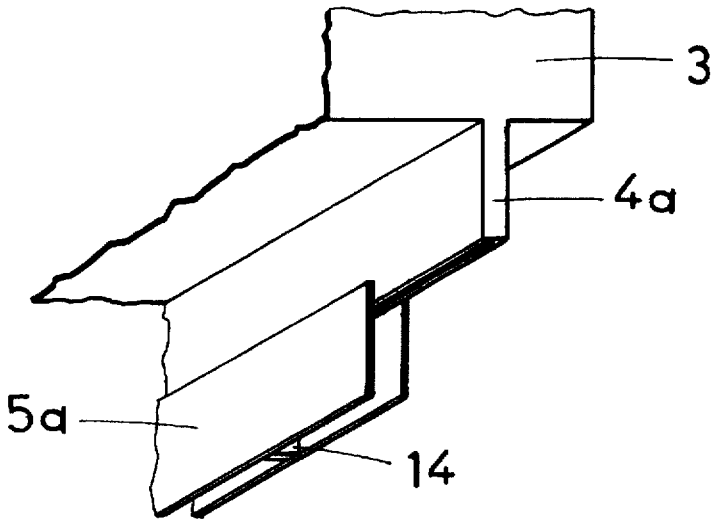
FIG. 5 shows part of a slot-shaped nozzle in a graphical representation.

We claim:

1. A system for the heat treatment of a metallic annealing material, which comprises a distributor for a gaseous heat treating medium, the distributor comprising tubular nozzles directing an oblique blast of the heat treating medium again the annealing material through orifices of the nozzles, the nozzles comprising telescopically retractable extensions for adjusting the distance between the nozzle orifices and the annealing material, a frame interconnecting the retractable extensions for common adjustment of the distance between the nozzle orifices and the annealing material.

2. The heat treatment system of claim 1, wherein the extensions define a narrow open space with the nozzles at the nozzle orifices.

3. The heat treatment system of claim 1, wherein the extensions are retractable through the nozzle orifices.

* * * * *